US006255924B1

(12) United States Patent
Turner et al.

(10) Patent No.: US 6,255,924 B1
(45) Date of Patent: Jul. 3, 2001

(54) SHOCK RESISTANT CIRCUIT BREAKER UVR

(75) Inventors: David Curtis Turner, Imperial; Christopher John Conway, Allison Park, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/587,764

(22) Filed: Jun. 6, 2000

(51) Int. Cl.[7] ..... H01H 3/60; H01H 9/00; H01H 75/00; H01H 77/00; H01H 83/00

(52) U.S. Cl. ..... 335/157; 335/6; 335/21; 335/172; 335/176

(58) Field of Search ..... 335/6, 21, 35, 335/157, 158, 172–176

(56) References Cited

U.S. PATENT DOCUMENTS 5,444,424 * 8/1995 Wong et al. ..... 335/172
5,726,614 * 3/1998 Castonguay et al. ..... 335/177

* cited by examiner

*Primary Examiner*—Ramon M. Barrera
(74) *Attorney, Agent, or Firm*—Martin J. Moran

(57) ABSTRACT

A shock resistant under-voltage release mechanism for a circuit breaker includes a magnetic tripping device resiliently mounted onto a mounting bracket with one or more resilient mounts. The magnetic tripping device includes a plunger that selectively engages a trip button of the circuit breaker when the voltage supplied to a coil of the magnetic tripping device drops below a given preset limit voltage. The resilient mounts each include first and second flanges, with a hub extending between the first and second flanges. The resilient mount is mounted on the mounting bracket of the under-voltage release mechanism such that the hub is disposed against a mounting hole formed in the mounting bracket, and the first and second flanges are disposed against the opposite faces of the mounting bracket. A fastener is slidingly received through an opening formed in each resilient mount and is attached onto an attachment hole formed on a coil frame of the magnetic tripping device. The resilient mounts thus resiliently mount the magnetic tripping device onto the mounting bracket which is, in turn, mounted to substantially stationary structures within the circuit breaker.

14 Claims, 1 Drawing Sheet

SHOCK RESISTANT CIRCUIT BREAKER UVR

BACKGROUND OF THE INVENTION

1. Field of the Invention

The present invention relates generally to shock-resistant circuit breakers and, more particularly, to a shock-resistant circuit breaker having an under-voltage release mechanism employing a resilient mount.

2. Description of the Related Art

Numerous types of circuit breakers are known and understood in the relevant art. Among the purposes for which circuit breakers are provided is to interrupt an electrical circuit on command or according to certain criteria. For instance, a given circuit breaker may be configured to interrupt a circuit during one or more specific overcurrent or an under-voltage conditions or other conditions. Circuit breakers typically include a set of moveable electrical contacts that are placed into a compressive abutting relationship with a set of stationary contacts to complete an electrical circuit. If it is desired to interrupt the electrical circuit, the moveable contacts are moved by a tripping mechanism away from the stationary contacts to break the electrical connection between the moveable and stationary contacts and to interrupt the electrical circuit. Numerous types of tripping mechanisms exist and are often tailored to meet specific needs of particular applications.

In multiple-pole circuit breakers, such tripping may occur by rotation of a trip bar to rapidly and simultaneously separate the moveable contacts from the stationary contacts of all of the poles to interrupt the electrical circuit. In such configurations, it is often desirable to additionally provide one or more trip buttons to enable rotation of the trip bar to operate the circuit breaker interruption mechanism during certain conditions. Such a trip button may be depressed manually or by a plunger of a trip mechanism, or may be operated by other electrical apparatus as needed for the specific application.

One such type of trip mechanism that may be used to engage a trip button of a circuit breaker is an under-voltage release mechanism. Such under-voltage release mechanisms employ a magnetic tripping device that includes a coil, a magnetically permeable core, and a magnetically permeable and movable plunger, as is generally known and understood in the relevant art. When the circuit breaker is in operation and the movable contacts are engaged with the stationary contacts, the coil is energized, whereby the plunger is magnetically biased against a spring. In such conditions, the magnetic interaction between the core, the plunger, and the magnetic field generated by the coil magnetically biases the plunger to overcome the spring and to retain the plunger in a retracted position and to keep the plunger away from the trip button. When the circuit voltage drops below a given preset level, however, the magnetic field generated by the coil becomes insufficient to overcome the force of the spring, with the spring then biasing the plunger into an extended position. The plunger in the extended position operatively engages the trip button to initiate rotation of the trip bar and interrupt the electrical circuit.

While such under-voltage release mechanisms have been effective for many of their intended purposes, such under-voltage release mechanisms are not without limitation. For instance, circuit breakers employing such under-voltage release mechanisms are subject to inadvertent and inappropriate tripping during shock loading of the circuit breaker. Such inappropriate tripping is to be particularly avoided in critical applications in which the loss of power would create an unsafe or harmful situation. It is thus desired to provide an under-voltage release mechanism that is resistant to shock loading, yet is capable of engaging the trip button of a circuit breaker under appropriate conditions.

SUMMARY OF THE INVENTION

In accordance with the foregoing, an under-voltage release mechanism for use in a circuit breaker includes a magnetic tripping device that is isolated by one or more resilient mounts from shock loading experienced by a mounting bracket mounted on the circuit breaker. The magnetic tripping device includes a coil mounted in a coil frame, a core disposed within the coil, and a plunger being movable with respect to the coil, with one or more resilient mounts being mounted between the coil frame and the mounting bracket. The coil frame is preferably mounted to the resilient mounts by a threaded fastener that extends through an opening formed in the resilient mount and that threadably compresses the coil frame against the resilient mount and secures the coil frame to the mounting bracket. The mounting bracket is mounted inside the circuit breaker.

An aspect of the present invention is to provide an under-voltage release mechanism for use in a circuit breaker having a structural member, in which the general nature of the under-voltage release mechanism can be stated as including a magnetic tripping device and at least a first resilient mount, the magnetic tripping device being mounted on the at least first resilient mount, the at least first resilient mount being structured to be mounted between the magnetic tripping device and the structural member.

Another aspect of the present invention is to provide a circuit breaker, the general nature of which can be stated as including a structural member, a trip mechanism including a magnetic tripping device, and at least a first resilient mount, the at least first resilient mount being at least partially disposed between the magnetic tripping device and the structural member.

Another aspect of the present invention is to provide a method of resisting shock-based tripping of a circuit breaker, the general nature of which can be stated as including the steps of providing a circuit breaker having a structural member, providing an under-voltage release mechanism including a magnetic tripping device, providing a resilient mount, and mounting the magnetic tripping device on the structural member, the resilient mount being operatively interposed between the magnetic tripping device and the structural member.

BRIEF DESCRIPTION OF THE DRAWINGS

The preferred embodiment of the invention, illustrative of the best mode in which Applicant has contemplated applying the principles of the invention, is set forth in the following description and is shown in the drawings and is particularly and distinctly pointed out and set forth in the appended claims.

Similar numerals refer to similar parts throughout the specification.

DESCRIPTION OF THE PREFERRED EMBODIMENT

Figure 1:
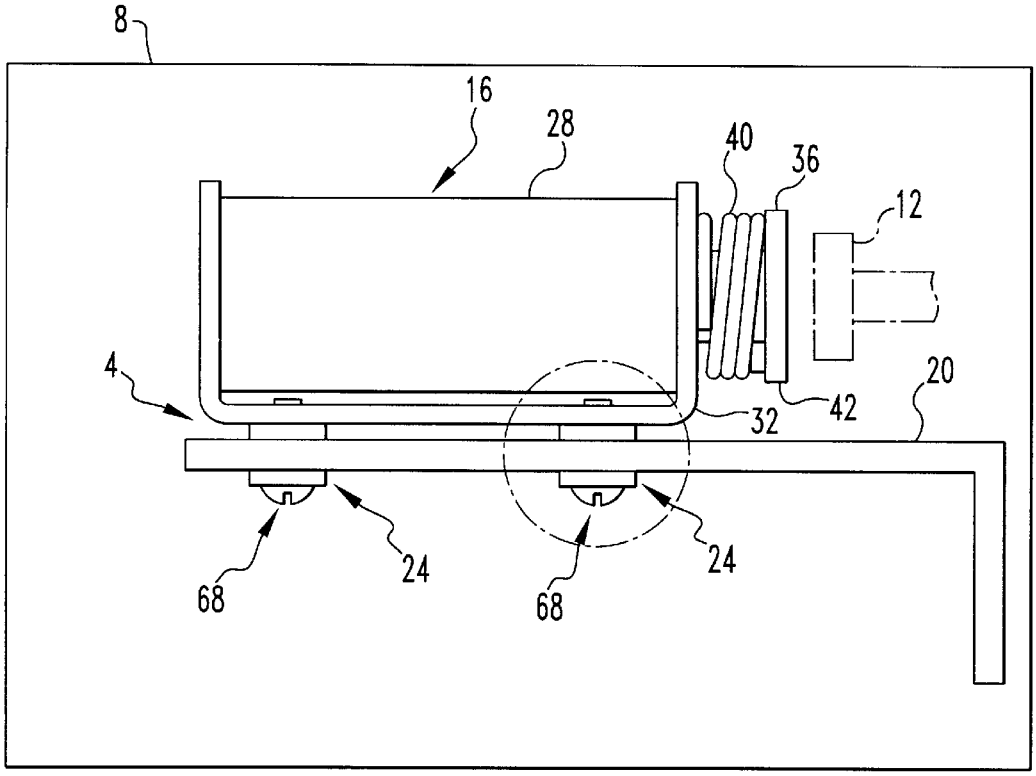
FIG. 1 is a view of a circuit breaker including an under-voltage release mechanism in accordance with the present invention.

A trip mechanism in the form of an under-voltage release mechanism 4 in accordance with the present invention is indicated generally in FIG. 1. The mechanism 4 is installed in a circuit breaker 8 and is configured to trip a trip button 12 in the circuit breaker 8 during a specified low-voltage condition. As is understood in the relevant art, the trip button 12 is operatively connected with a tripping mechanism that moves one or more moveable contacts out of electrical connection with a corresponding number of stationary electrical contacts to interrupt the flow of electricity through the circuit breaker 8.

The mechanism 4 includes a magnetic tripping device 16 that is resiliently mounted onto a mounting bracket 20 with one or more resilient mounts 24 that are depicted herein as grommets. The mounting bracket 20 is securely mounted to substantially rigid structures within the circuit breaker 8. As will be set forth more fully below, the resilient mounts or grommets 24 that mount between the mounting bracket 20 and the magnetic tripping device 16 advantageously resist the transmission of shock loading experienced by the circuit breaker 8 to the magnetic tripping device 16 during normal usage thereof.

The magnetic tripping device 16 includes a coil 28 that is fixedly mounted in a coil frame 32, a plunger 36, and a spring 40. The coil 28 includes a plurality of windings that cooperate with the coil frame 32 to generate a magnetic field in a known fashion when electricity is applied to the windings. The coil frame 32 is a substantially rigid structure that securely mounts the coil 28 therein and facilitates attachment of the coil 28 onto other structures.

The coil 28 is formed with a cylindrical channel (not shown) extending therethrough that reciprocatingly receives the plunger 36. As is understood in the relevant art, the coil 28 further includes a magnetically permeable core (not shown) that magnetically interacts with the plunger 36 and the magnetic field generated by the coil 28 to retain the plunger 36 in the retracted position depicted generally in FIG. 1 when the voltage applied to the coil 28 is at or above a certain specified limit voltage.

As can be seen in FIG. 1, the spring 40 is retained between the coil frame 32 and a circular plate 42 that is disposed at one end of the plunger 36 and extends radially outwardly therefrom. When the coil 28 is energized at or above the specified limit voltage, the magnetic interaction between the coil 28, the core, and the plunger 36 overcomes the force of the spring 40 and biases the plunger 36 to the retracted position depicted in FIG. 1, and thereby retains the spring 40 in a compressed condition. While the spring 40 is depicted as being a compression coil spring, it is understood that the spring 40 could be of other configurations such as a tension spring as well as numerous other appropriate configurations without departing from the spirit of the present invention.

When the coil 28 is energized at a voltage in excess of the predetermined limit voltage, the magnetic field generated thereby overcomes the compressive force of the spring 40 and retains the plunger in the retracted position depicted in FIG. 1. When the coil 28 is energized precisely at the limit voltage, the magnetic filed generated by the coil 28 is just barely enough to overcome the compressive force of the spring 40.

If the voltage supplied to the coil 28 drops below the predetermined limit voltage at any time, the magnetic field generated by the coil 28 is insufficient to overcome the compressive force of the spring 40. As is understood in the relevant art, in such conditions the spring 40 drives the plunger 36 away from the coil 28 and into operative contact with the trip button 12, which in turn triggers the trip mechanism to interrupt the current passing through circuit breaker 8.

After tripping, once the electricity supplied to the coil 28 returns to a voltage at or above the predetermined limit voltage, the plunger 36 typically must be returned by a known resetting mechanism (not shown) that pushes the plunger to the retracted position depicted in FIG. 1 while simultaneously compressing the spring 40. Such a resetting mechanism typically is necessary to return the plunger 36 to the retracted position and remove the plunger 36 from operative contact with the trip button 12 inasmuch as the magnetic field generated by the coil 28 when the voltage supplied thereto is at or above the predetermined limit voltage typically is sufficient only to retain the plunger 36 in the retracted position and is insufficient, on its own, to pull the plunger 36 out of operative contact with the trip button 12 and simultaneously compress the spring 40.

Figure 2:
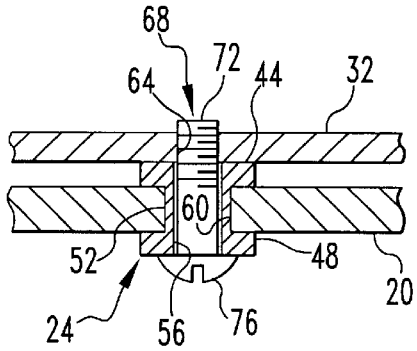
FIG. 2 is an enlarged view of the encircled portion of FIG. 1, partially cut away.
Figure 3:
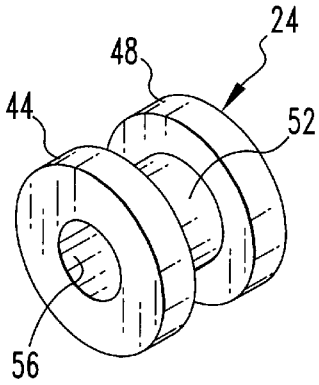
FIG. 3 is an isometric view of a resilient mount in accordance with the present invention.

As is depicted in FIGS. 2 and 3, each resilient mount 24 includes an annular first flange 44, an annular second flange 48, and a hollow, substantially cylindrical hub 52. The hub 52 is interposed between the first and second flanges 44 and 48, with the first and second flanges 44 and 48 and the hub 52 being axially aligned with one another. Each resilient mount 24 is also formed with a substantially cylindrical opening 56 extending therethrough and oriented coaxially with the first and second flanges 44 and 48 and the hub 52 and passing therethrough. The resilient mounts 24 are preferably manufactured out of a resilient material such as various types of rubber and synthetic rubber compounds, although other appropriate materials may be used depending upon the specific needs of the particular application.

As is best shown in FIG. 2, the mounting bracket 20 is formed with one or more cylindrical mounting holes 60 extending therethrough, and the coil frame 32 includes an equal number of substantially cylindrical attachment holes 64 extending therethrough. Each mounting hole 60 receives one of the resilient mounts 24 therein as is depicted generally in FIG. 2, with the hub 52 being disposed against the mounting hole 60 and with the first and second flanges 44 and 48 being disposed against the opposite faces of the mounting bracket 20.

The hub 52 is preferably configured to have a longitudinal length that is substantially equal to the thickness of the mounting bracket 20 in the vicinity of the attachments holes 64, such that the resilient mount 24 remains tightly disposed in the mounting hole 60 with the first and second flanges 44 and 48 tightly disposed against the opposite faces of the mounting bracket 20 with minimal play therebetween. The hub 52 is also preferably configured to have an outer diameter that is roughly equal to or at most only nominally greater than the diameter of the mounting hole 60, such that the outer surface of the hub 52 remains securely disposed against the mounting hole 60 with minimal play therebetween. It is understood, of course, that numerous other configurations for the resilient mounts 24 may be appropriate depending upon the specific needs of the particular application.

Once the resilient mounts 24 have been received in the mounting holes 60 in the manner set forth above, each of the resilient mounts 24 receives a fastener 68 through the opening 56, with each of the fasteners 68 then being received in the attachment holes 64. The fastener 68 depicted generally in FIG. 2, is a threaded machine screw having a threaded shank 72 and a flared portion in the form of a head 76 having a greater outer diameter than that of shank 72. The threaded shank 72 includes an external helical thread formed on the outer surface thereof. Each attachment hole 64 is correspondingly formed with an internal helical thread that threadably interacts with the external thread formed on the shank 72. The shanks 72 of the fasteners 68 are slidingly received through the openings 56 formed in the resilient mounts 24 and are then threadably received in the attachment holes 64 formed in the coil frame 32. The fasteners 68 are tightened to an appropriate torque and the coil frame 32 is then resiliently fastened onto the mounting bracket 20. While the fasteners 68 are depicted herein as being threaded machine screws, it is understood that the fasteners 68 could be other types of fasteners such as bolts, rivets, or other appropriate fasteners depending upon the specific needs of the particular application without departing from the spirit of the present invention.

The coil frame 32 is fastened onto the mounting bracket 20 with four of the resilient mounts 24, meaning that the mounting bracket 20 is formed with four mounting holes 60 and the coil frame 32 is formed with four attachment holes 64 that are arranged thereon to match the arrangement of the mounting holes 60 on the mounting bracket 20. It is understood, of course, that a greater or lesser number of resilient mounts 24 may be used in attaching the coil frame 32 onto the mounting bracket 20, depending upon the specific needs of the particular application without departing from the spirit of the present invention.

When the resilient mounts 24 are received in the mounting holes 60 and the coil frame 32 is mounted on the mounting bracket 20 with the fasteners 68, the first flange 44 is compressed between the coil frame 32 and the mounting bracket 20. Likewise, the second flange 48 is compressed between the mounting bracket 20 and the head 76 or flared end of the fastener 68. The compression of the resilient mounts 24 by the fastener 68 securely mounts the coil frame 32 onto the mounting bracket 20.

It can additionally be seen in FIG. 2 that while the coil frame 32 is securely mounted onto the resilient mounts 24 with the fasteners 68, and the resilient mounts 24 are mounted onto the mounting bracket 20 through the mounting holes 60, no rigid structures of the magnetic tripping device 16, such as the coil frame 32 or the fasteners 68, are in direct contact with the mounting bracket 20. Rather, the coil frame 32 and the fasteners 68 are resiliently mounted on the mounting bracket 20 by way of the resilient mounts 24 being operationally and resiliently interposed between the magnetic tripping device 16 and the mounting bracket 20.

The positioning of the resilient mounts 24 between the mounting bracket 20 and the magnetic tripping device 16 isolates the magnetic tripping device 16 from shock loading experienced by the circuit breaker 8 during normal use thereof. As is understood in the relevant art, shock loading of the circuit breaker, if transmitted to the coil 28, can result in vibration and movement of the coil 28 with respect to the plunger 36. Inasmuch as the coil 28, plunger 36, and spring 40 are together resiliently mounted on the mounting bracket 20 with the resilient mounts 24, the resilient mounting provided by the resilient mounts 24 resists movement of the coil 28 with respect to the plunger 36.

Inasmuch as the coil 28 is typically configured to generate a magnetic field that just barely overcomes the force of the spring 40 when the electricity supplied to the coil 28 is at the predetermined limit voltage, small movements of the coil 28 with respect to the plunger 36, if properly directed, can result in a force on the plunger 36 that is additive with the force of the spring. Such a combination of forces can cause the plunger 36 to inappropriately move from the retracted position depicted in FIG. 1 to an extended position in which the plunger 36 inappropriately contacts the trip button 12 to trip the circuit breaker 8 and interrupt the corresponding electrical circuit. The resilient mounts 24 resiliently isolate the magnetic tripping device 16 from shock loading experienced by the circuit breaker 8, which thus resists inappropriate shock based tripping by the under-voltage release mechanism 4.

While the magnetic tripping device 16 is depicted herein as being advantageously resiliently mounted onto the mounting bracket 20, it is further understood that the mounting bracket 20 either may be rigidly mounted onto substantially stationary structures within the circuit breaker 8 or may be resiliently mounted thereto using additional resilient mounts 24. In the event that resilient mounts 24 are employed to mount the mounting bracket 20 onto the stationary structures of the circuit breaker 8, it is further understood that the magnetic tripping device 16 may, in some configurations, be rigidly mounted onto the mounting bracket 20, or may be resiliently mounted thereto with one or more of the resilient mounts 24 as set forth herein. As a further alternative, it is understood that the magnetic tripping device 16 can be resiliently mounted with the resilient mounts 24 directly onto the substantially stationary structures within the circuit breaker 8.

While the specific configuration of the resilient mount 24 depicted herein includes first and second flanges 44 and 48 connected with one another by the hub 52, it is understood that alternative configurations for the resilient mount 24 may be appropriate depending upon the specific configuration of the circuit breaker, the type of shock loading typically experienced by the circuit breaker, as well as other appropriate factors, without departing from the spirit of the present invention. It may additionally be appropriate to mount the coil frame 32 directly onto the resilient mount 24 with alternative attachment structures such as nipples or other structures that are integrally formed with the resilient mounts 24 such that the resilient mounts 24 may be unitary members including structures that can serve as fasteners for fastening the coil frame 32 and/or the mounting bracket onto the resilient mounts 24.

While a particular embodiment of the present invention has been described herein, it is understood that various changes, additions, modifications, and adaptations may be made without departing from the scope of the present invention, as set forth in the following claims.

What is claimed is:

1. An under-voltage release mechanism for use in a circuit breaker having a structural member, the under-voltage release mechanism comprising:

a magnetic tripping device;

at least a first resilient mount, the magnetic tripping device being mounted on the at least first resilient mount, the at least first resilient mount being structured to be mounted between the magnetic tripping device and the structural member;

the magnetic tripping device includes a fastener, the at least first resilient mount is formed with an opening, the fastener at least partially extending through the opening;

the magnetic tripping device includes a coil frame, the fastener extending through the opening formed in the at least first resilient mount; and the at least first resilient mount includes at least a first flange and a hub, the at least first flange being disposed on one end of the hub, the opening extending through the at least first flange and hub.

2. The under-voltage release mechanism as set forth in claim 1, in which the at least first resilient mount further includes a second flange, the at least first and second flanges being disposed on opposite ends of the hub, the opening extending through the at least first and second flanges and the hub, the opening being coaxially aligned with the hub.

3. The under-voltage release mechanism as set forth in claim 2, further comprising a mounting bracket, at least first resilient mount being mounted on one of the coil frame and the mounting bracket, the mounting bracket being structured to be mounted onto the structural member.

4. The under-voltage release mechanism as set forth in claim 3, in which the fastener has a flared portion disposed against one of the first and second flanges, and in which one of the coil frame and the mounting bracket is disposed against the other of the first and second flanges.

5. The under-voltage release mechanism as set forth in claim 3, in which the mounting bracket is formed with at least a first mounting hole, the at least first resilient mount being mounted in the at least first mounting hole.

6. The under-voltage release mechanism as set forth in claim 5, in which the hub is disposed in the at least first mounting hole, the at least first and second flanges being disposed against opposite faces of the mounting bracket.

7. A circuit breaker comprising:

a structural member;

a trip mechanism including a magnetic tripping device;

at least a first resilient mount;

the at least first resilient mount being at least partially disposed between the magnetic tripping device and the structural member; and the at least first resilient mount includes a hub and at least a first flange being interposed between the magnetic tripping device and the structural member.

8. The circuit breaker as set forth in claim 7, in which the structural member is formed with a mounting hole, the hub at least partially extending through the mounting hole.

9. The circuit breaker as set forth in claim 8, in which the magnetic tripping device includes a fastener and in which the at least first resilient mount is formed with an opening, the opening being coaxially aligned with the hub, the fastener extending through the opening.

10. The circuit breaker as set forth in claim 9, in which the at least first resilient mount further includes a second flange, the at least first and second flanges being disposed against opposite faces of the structural member.

11. The circuit breaker as set forth in claim 10, in which the fastener includes a flared portion, the fastener being mounted on the magnetic tripping device, the flared portion being disposed against the second flange.

12. A method of resisting shock-based tripping of a circuit breaker comprising the steps of:

providing a circuit breaker having a structural member;

providing an under-voltage release mechanism including a magnetic tripping device;

providing a resilient mount;

mounting the magnetic tripping device on the structural member, the resilient mount being operatively interposed between the magnetic tripping device and the structural member; and the resilient mount includes a first flange, a second flange, and a hub, the first and second flanges being disposed on alternate ends of the hub, and further comprising the step of compressing the first flange between the magnetic tripping device and the structural member.

13. The method as set forth in claim 12, in which the resilient mount is formed with an opening extending therethrough, and further comprising the steps of providing a fastener, receiving at least a portion of the fastener through the opening, and attaching the fastener onto one of the structural member and the magnetic tripping device.

14. The method as set forth in claim 13, in which the fastener includes a flared portion, and further comprising the step of compressing the flared portion against the second flange.

* * * * *